US005285623A

United States Patent [19]

Baillievier et al.

[11] Patent Number: 5,285,623

[45] Date of Patent: Feb. 15, 1994

[54] STEEL CORD WITH IMPROVED FATIGUE STRENGTH

[75] Inventors: Freddy Baillievier; Bernard Huysentruyt, both of Zwevegem, Belgium

[73] Assignee: N.V. Bekaert S.A., Zwevegem, Belgium

[21] Appl. No.: 983,275

[22] Filed: Nov. 30, 1992

Related U.S. Application Data

[63] Continuation of Ser. No. 761,867, Sep. 13, 1991, abandoned.

[30] Foreign Application Priority Data

Apr. 3, 1989 [EP] European Pat. Off. ..... 89200838.4

[51] Int. Cl.[5] ..... D02G 3/48

[52] U.S. Cl. ..... 57/236; 57/902

[58] Field of Search ..... 57/200, 236, 237, 241, 57/242, 211, 902

[56] References Cited

U.S. PATENT DOCUMENTS 4,408,444 10/1983 Baillievier et al. ..... 57/237
4,506,500 3/1985 Miyauchi et al. ..... 57/212
4,644,989 2/1987 Charvet et al. ..... 57/236 X

FOREIGN PATENT DOCUMENTS 0168857 3/1988 European Pat. Off. .
2477584 9/1981 France .
84844 11/1983 Luxembourg .

*Primary Examiner*—Joseph J. Hail, III
*Attorney, Agent, or Firm*—Foley & Lardner

[57] ABSTRACT

A steel cord (1) for the reinforcement of elastomers, especially for the reinforcement of breaker layers in a tire, said steel cord comprising two strands of at least two filaments (11, 12) each, said strands being twisted around each other and forming helicoids of a same pitch, the filaments (11) of the first strand having a pitch differing from the pitch of said helicoids and having a value of more than 300 mm, the filaments (12) of the second strand having the same pitch as said helocoids and being twisted in the same sense as said helicoids, all the filaments of both of said strands having a diameter between 0.08 and 0.45 mm, wherein the diameter of the filaments of one of said strands is at least 0.02 mm greater than the diameter of the filaments of the other of said strands. Preferably the diameter of the filaments (12) of said second strand is at least 0.02 mm greater than the diameter of the filaments (11) of said first strand.

4 Claims, 2 Drawing Sheets

STEEL CORD WITH IMPROVED FATIGUE STRENGTH

This application is a continuation of application Ser. No. 07/761,867, filed Sep. 13, 1991, now abandoned.

BACKGROUND OF THE INVENTION

The invention relates to a steel cord for the reinforcement of elastomers, comprising two strands of at least two filaments each so as to form an m+n -structure, where m is the number of filaments of the first strand and n the number of filaments of the second strand, m and n being greater than or equal to two.

The steel cord according to the invention is particularly suitable for use as a reinforcement of rubber articles such as tires, and more particularly for use as a reinforcement of breaker layers in a tire.

Steel cords for use as a reinforcement of breaker layers in a tire conveniently comprise steel filaments having a diameter between 0.05 mm and 0.60mm, preferably between 0.15 and 0.45 mm. A conventional steel composition for such steel cords is a carbon content above 0.65 %, preferably above 0.80 %, e.g. 0.83 % or 0.85 %, a manganese content between 0.40 and 0.70 %, a silicon content between 0.15 and 0.30 %, and maximum sulphur and phosphorus contents of 0.03 %. However, the invention is not limited to such a steel composition. Other elements such as chromium, nickel or boron may also be added. The steel cord usually has a rubber adherable layer such as a copper, zinc, or brass alloy.

The state of the art of steel cords for reinforcement of elastomers, and more particularly for reinforcement of a breaker layer of a tire provides several different constructions.

Among these constructions the n×1 -constructions occupy a special place. These are constructions with n filaments twisted together with the same twist pitch and in the same twist sense, n is an integer number between 3 and 5. The problem with these constructions is that they have a central void where rubber cannot penetrate during vulcanisation and where moisture may easily enter and cause corrosion.

A solution to this problem has been given by the open n×1 -constructions. These are constructions where one or more filaments are kept apart from each other by giving them a specified preformation during the twisting process. However, this preformation must exceed a certain limit in order to avoid closing the steel cord when this is put under tension during the vulcanisation process. The problem is then that too high a preformation may cause an irregular cord aspect and instability.

In addition to the n×1 -constructions the 2+2 -construction which is disclosed in US-A-4,408,444 has been widely used in the tire manufacturing industry too. This cord has the advantage of having full rubber penetration whether brought under tension or not, but has the drawbacks of a poor fatigue limit and a still too great cord diameter. As a consequence this cord is less suitable when a high fatigue performance is required or when a thin rubber ply is a priority.

OBJECTS AND SUMMARY OF THE INVENTION

It is an object of the present invention to avoid one or more drawbacks of the prior art.

It is also an object of the present invention to provide a cord with a high fatigue performance whilst still enabling full rubber penetration.

According to the present invention there is provided a steel cord for the reinforcement of elastomers, which comprises two strands of at least two filaments each. These strands are twisted around each other and form helicoids of a same pitch. The filaments of the first strand have a pitch differing from the pitch of said helicoids and have a value of more than 300 mm. The filaments of the second strand have the same pitch as the helicoids and are twisted in the same sense as the helicoids. All the filaments of both strands have a diameter between 0.08 and 0.45 mm. The diameter of the filaments of one of the strands is at least 0.02 mm greater than the diameter of the filaments of the other of the strands.

According to a preferable embodiment of the invention the diameter of the filaments of the second strand is at least 0.02 mm greater than the diameter of the filaments of the first strand, and preferably up to 0.12 mm greater than the diameter of the filaments of the first strand.

In this way an alternative m+n -construction is provided, where m is the number of filaments of the first strand and n the number of filaments of the second strand.

The filaments conveniently have a circular cross-section, but this is not necessary. In cases where the filaments don't have a circular cross-section, "diameter" means the diameter of a circular cross-section with the same surface as the cross-section of the filaments.

The filaments within one strand conveniently have the same diameter, but small differences in the range of 0.01 mm–0.02 mm may occur.

As will be shown below the inventors have surprisingly found that the fatigue limit of the cord according to the invention is much higher than the fatigue limit of a conventional m+n -construction with the same cross-sectional surface. This is surprising because the diameter of the filaments of one strand has been decreased with respect to the conventional m+n -construction and the diameter of the filaments of the other strand has been increased with respect to the conventional m+n -construction in order to obtain about the same cross-sectional surface and hence reinforcing effect. It is hereby understood that, as is generally known in the art, decreasing the diameter of filaments increases the fatigue limit and increasing the diameter of filaments decreases the fatigue limit.

Preferably, the number of steel filaments in the first strand is equal to the number of steel filaments in the second strand and most preferably this number is equal to two.

The steel filaments in both strands may have a normal tensile strength, i.e. a tensile strength below the value of $$R_m = 2250 - 1130 \log d \ (N/mm^2) \qquad \text{(I)},$$

where d is the diameter expressed in mm, or they may have a high tensile strength, i.e. a tensile strength above the value of formula (I).

In a special way of carrying out the invention the filaments of one strand have a normal tensile strength and the filaments of the other strength have a high tensile strength.

If the filaments of the first strand have the smaller diameter and have a high tensile strength and the filaments of the second strand have the greater diameter and have a normal tensile strength, then the loss in reinforcing strength of the first strand with regard to the second strength due to the smaller diameters may be compensated so that both strands equally contribute to the tensile strength of the whole cord. However, this is not necessary: the filaments of the first strand having the smaller diameter may also have a normal tensile strength while the filaments of the second strand having the greater diameter have a high tensile strength.

It is also clear that by using filaments with a high tensile strength, the overall diameter of the cord may be decreased without loss of tensile strength with regard to m+n-cords with all filaments having a normal tensile strength.

BRIEF DESCRIPTION OF THE DRAWINGS

The invention will now be described in more detail with reference to the accompanying drawings wherein.

DETAILED DESCRIPTION OF THE PREFERRED EMBODIMENTS

Figure 1:
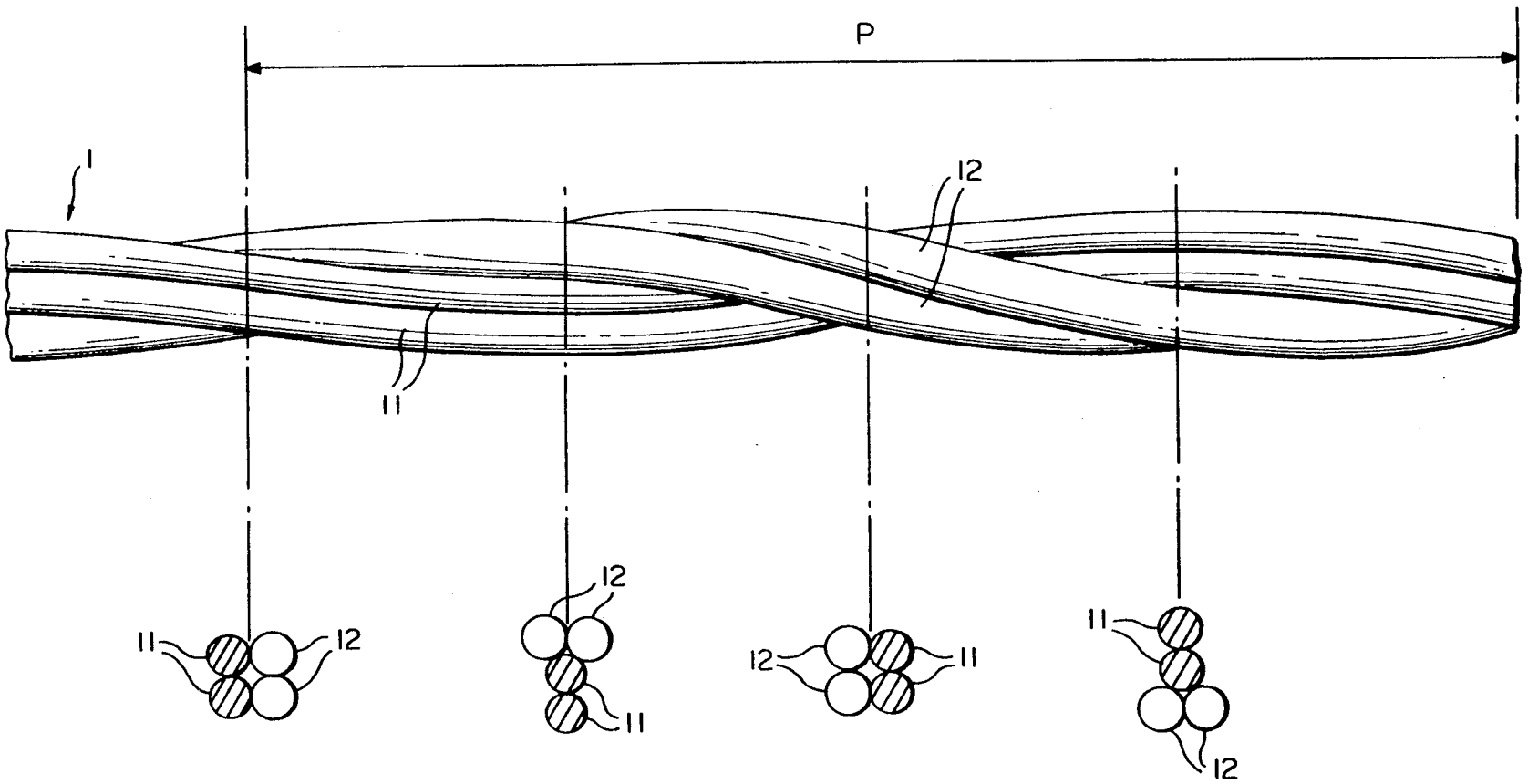
FIG. 1 represents a side view and subsequent cross-sections of a cord according to the present invention.

FIG. 1 represents a cord 1 according to the present invention. The cord consists of a first strand having two filaments 11 and a second strand also having two filaments 12. The cross-section of the filaments 11 of the first strand is shaded. The filaments 11 have a diameter of 0.24 mm and the filaments 12 have a diameter of 0.28 mm. The two strands are twisted around each other with a twist pitch p of 15 mm. The twist pitch p conveniently lies between 30 and 100 times the average diameter of the filaments and preferably between 40 and 80 times the average diameter of the filaments. The filaments 12 of the second strand are twisted in the same sense with the same twist pitch p while the filaments 11 of the first strand remain substantially parallel to each other, i.e. they have an infinite twist pitch.

Figure 2:
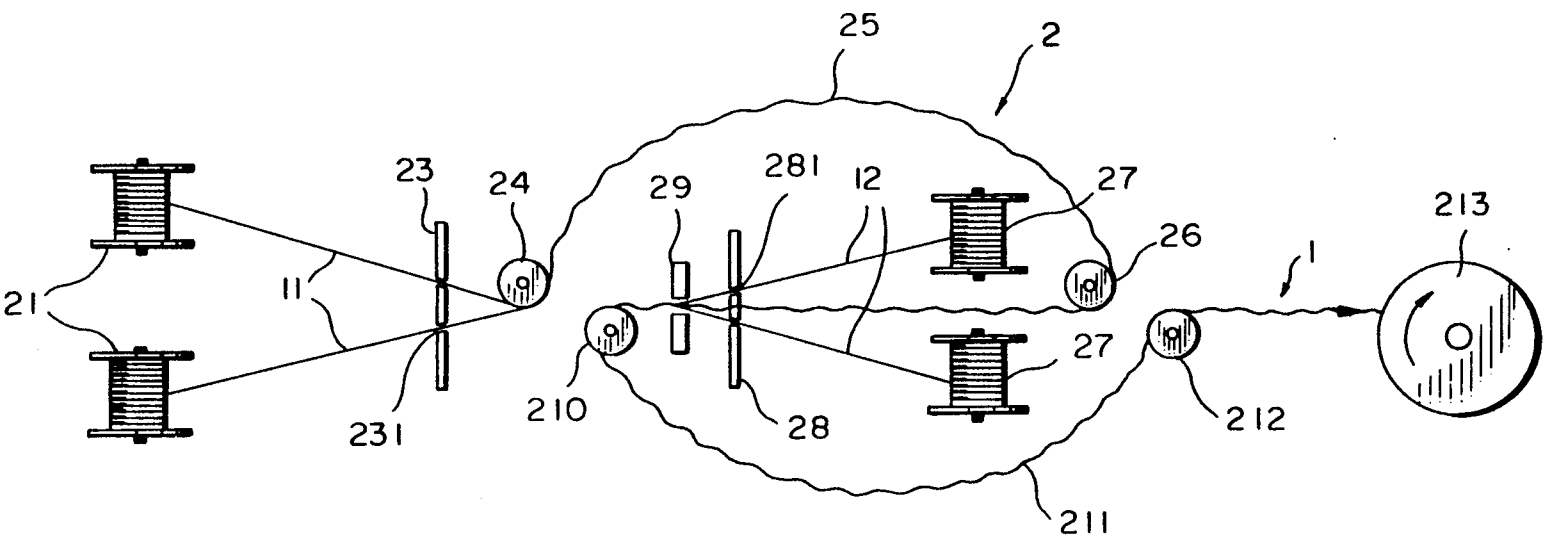
FIG. 2 represents an apparatus for manufacturing a cord according to the present invention.

FIG. 2 represents a double-twisting apparatus 2 for manufacturing a cord according to the present invention. The filaments 11 of the first strand are drawn from bobbins 21 and pass through the holes 231 of a guiding plate 23 and come together at a first guiding pulley 24 of the double-twister 2 where they are provisionally twisted together. They pass further over a flyer 25 and over a reversing pulley 26. Two bobbins 27 are stationarily mounted inside the rotor of the double-twister 2. The filaments 12 of the second strand are drawn from these bobbins 27 and pass through the holes 281 of a guiding plate 28 and come together with the provisionally twisted filaments 11 at the cabling die 29. The filaments 11 and 12 pass over reversing pulley 210, flyer 211 and guiding pulley 212 to the winding unit 213. Between the cabling die 29 and the guiding pulley 212 the filaments 11 are untwisted so as to form a first strand consisting of substantially parallel filaments 11, while the filaments 12 are twisted with the same pitch and in the same direction as the two strands.

TEST 1

The fatigue properties of two prior art cords have been compared with a cord according to the present invention (NT=normal tensile, i.e. a tensile strength below the value of formula (I); HT=high tensile, i.e. a tensile strength above the value of formula (I)):

| | |
|---|---|
| 1. prior art cord | 2 × 0.25 NT + 2 × 0.25 NT; pitch = 14 mm |
| 2. prior art cord | 2 × 0.25 HT + 2 × 0.25 HT; pitch = 14 mm |
| 3. invention cord | 2 × 0.22 NT + 2 × 0.28 HT; pitch = 14 mm |

It is understood that in these constructions the first strand with substantially parallel filaments is named first and the second strand with twisted filaments is named second.

TABLE 1

| cord | cross-section ($mm^2$) | breaking load (N) | fatigue limit ($N/mm^2$) |
|---|---|---|---|
| A. 1. | 0.196 | 530 | <600 |
| 2. | 0.196 | 605 | <600 |
| 3. | 0.199 | 604 | 850 |
| B. 1. | 0.196 | 520 | 800 |
| 2. | 0.196 | 633 | 700 |
| 3. | 0.199 | 621 | 900 |
| 3. | 0.199 | 581 | 900 |

The fatigue limit has been measured with the well-known Hunter test.

The second series B. of tests has been made on cords from a slightly different steel rod type than this of series A.

In both series it may be easily seen that the cord 3. according to the invention has a much higher fatigue limit than the cords 1. and 2. according to the prior art.

TEST 2

A second test reveals an additional advantage of the cord according to the invention, namely a better behaviour under compression.

The same cords as mentioned under Test 1 have been compared with each other. The buckling stress, the deformation at the buckling stress, and the Young's modulus in compression have been measured for these cords.

The buckling stress is a measure for the maximum compression force taken up by the steel cord when embedded in rubber. The greater the buckling stress the greater this maximum compression force.

The deformation is the deformation of the cord in rubber when subjected to this maximum compression.

A high Young's modulus in compression means a cord which does not allow high deformations under compression whereas a low Young's modulus in compression allows high deformations under compression.

Further details about these features and their method of measurement may be found in the paper by Bourgois L., Survey of Mechanical Properties of Steel Cord and Related Test Methods, Tire Reinforcement and Tire Performance, ASTM STP 694, R. A. Fleming and D. I. Livingston, Eds., American Society for Testing and Materials, 1979, pp. 19–46.

Table 2 mentions the results:

TABLE 2

| | COMPRESSION BEHAVIOUR | | |
|---|---|---|---|
| cord | buckling stress ($N/mm^2$) | deformation (%) | compression modulus ($kN/mm^2$) |
| 1. | 430 | 0.40 | 125 |
| 2. | 447 | 0.40 | 125 |
| 3. | 475 | 1.12 | 66 |

TEST 3

A third test has evaluated the influence of the diameter difference between the two strands on the cord properties. Following cords have been evaluated:

| | |
|---|---|
| 1. invention cord | 2 × 0.22 HT + 2 × 0.25 HT pitch: 14 mm |
| 2. invention cord | 2 × 0.25 NT + 2 × 0.28 HT pitch: 14 mm |
| 3. invention cord | 2 × 0.20 HT + 2 × 0.25 HT pitch: 14 mm |
| 4. invention cord | 2 × 0.25 HT + 2 × 0.30 HT pitch: 16 mm |
| 5. invention cord | 2 × 0.22 NT + 2 × 0.28 HT pitch: 14 mm |
| 6. invention cord | 2 × 0.22 HT + 2 × 0.30 HT pitch: 14 mm |
| 7. invention cord | 2 × 0.20 HT + 2 × 0.30 HT pitch: 14 mm |
| 8. invention cord | 2 × 0.22 HT + 2 × 0.35 HT pitch: 16 mm |

Table 3 summarizes the results of the P.L.E. values and of the fatigue properties of these cords.

P.L.E. means here part load elongation. It is defined as the increase in length of a gauge length between a tension of 2.5N and a tension of 50N and may be expressed as a percentage of the original gauge length. It is a measure of the openness of the steel cord.

TABLE 3

| cord | diameter difference (mm) | P.L.E. 2.5–50 N (%) | fatigue limit Hunter test ($N/mm^2$) |
|---|---|---|---|
| 1. | 0.03 | 0.16 | 850 |
| 2. | 0.03 | 0.16 | 850 |
| 3. | 0.05 | 0.17 | 850 |
| 4. | 0.05 | 0.14 | 900 |
| 5. | 0.06 | 0.14 | 850 |
| | 0.06 | 0.18 | 900 |
| | 0.06 | 0.17 | 900 |
| 6. | 0.08 | 0.13 | 900 |
| 7. | 0.10 | 0.14 | 1050 |
| 8. | 0.13 | 0.40 | 950 |

The fatigue limit remains high with increasing diameter difference. However, with a diameter difference of 0.13 mm a P.L.E. value of 0.40 has been measured. This means that the cord is open: the different filaments do no longer make contact with other filaments over the whole length. In contradiction to n×1 -cords, this is not desired with m+n -cords. And this is the reason why in a preferred embodiment of the invention the diameter difference is kept below 0.12 mm (see claim 3).

We claim:

1. A steel cord for the reinforcement of elastomers, said steel cord comprising:

two strands of at least two filaments each, said strands being twisted around each other and forming helicoids of a first pitch, the filaments of the first strand having essentially the same diameter and having a second pitch differing from the first pitch, said second pitch being more than 300 mm, the filaments of the second strand having essentially the same diameter and having the first pitch and being twisted in the same sense as said helicoids, all the filaments of both of said strands having a diameter between 0.08 and 0.45 mm, the diameter of the filaments of said second strand being at least 0.02 mm greater than the diameter of the filaments of said first strand, wherein the filaments of one of said strands have a tensile strength above 2250–1130 log d $N/mm^2$, d being the filament diameter of the one strand expressed in mm, while the filaments of the other of said strands have a tensile strength below 2250–1130 log d $N/mm^2$, d being the filament of the other strand expressed in mm.

2. A steel cord according to claim 1, wherein the diameter of the filaments of said second strand is up to 0.12 mm greater than the diameter of the filaments of said first strand.

3. A steel cord according to claim 1, wherein the number of filaments of said first strand is equal to the number of filaments of said second strand.

4. A steel cord according to claim 1, wherein each of said strands consists of two filaments.

* * * * *